US012428121B2

(12) United States Patent
Carlsson

(10) Patent No.: US 12,428,121 B2
(45) Date of Patent: Sep. 30, 2025

(54) MARINE PROPULSION UNIT AND MARINE VESSEL

(71) Applicant: VOLVO PENTA CORPORATION, Gothenburg (SE)

(72) Inventor: Lars-Gunnar Carlsson, Torslanda (SE)

(73) Assignee: VOLVO PENTA CORPORATION, Gothenburg (SE)

( * ) Notice: Subject to any disclaimer, the term of this patent is extended or adjusted under 35 U.S.C. 154(b) by 661 days.

(21) Appl. No.: 17/757,605

(22) PCT Filed: Dec. 20, 2019

(86) PCT No.: PCT/EP2019/086665

§ 371 (c)(1),
(2) Date: Jun. 17, 2022

(87) PCT Pub. No.: WO2021/121623

PCT Pub. Date: Jun. 24, 2021

(65) Prior Publication Data

US 2023/0036549 A1 Feb. 2, 2023

(51) Int. Cl.
*B63H 23/12* (2006.01)
*B63H 21/17* (2006.01)
(Continued)

(52) U.S. Cl.
CPC ..... *B63H 23/12* (2013.01); *B63H 21/17* (2013.01); *B63H 21/30* (2013.01); *B63H 21/386* (2013.01); *B63H 2023/0283* (2013.01)

(58) Field of Classification Search
CPC ..... B63H 23/12; B63H 2023/0283; B63H 21/17; B63H 21/30; B63H 21/386
See application file for complete search history.

(56) References Cited

U.S. PATENT DOCUMENTS 6,685,516 B2 2/2004 Tsuboguchi
7,070,469 B2 * 7/2006 Stallings ..... B63H 20/34 440/79

(Continued)

FOREIGN PATENT DOCUMENTS

CN 200971950 Y 11/2007
CN 110740930 A 1/2020

(Continued)

OTHER PUBLICATIONS

International Search Report and Written Opinion in corresponding International Application No. PCT/EP2019/086665 mailed Sep. 24, 2020 (10 pages).

(Continued)

*Primary Examiner* — Stephen P Avila
(74) *Attorney, Agent, or Firm* — Venable LLP; Jeffri A. Kaminski

(57) ABSTRACT

A marine propulsion unit includes a stern drive mounted to a transom. The stern drive comprises an upper unit enclosed in a stern drive housing and a lower unit enclosed in a gearbox housing; wherein the gearbox housing contains a gearbox arranged to drive at least one propeller. The propulsion unit further comprises at least two electric motors arranged in the stern drive housing, which electric motors are mounted with vertical output shafts; a planetary gear set arranged between the at least two electric motors and the gearbox, and a vertical shaft that is attached to a ring gear of the planetary gear set at its upper end and is connected to the gearbox at its lower end; wherein the output shaft of each electric motor is connected to a planetary gear arranged in the planetary gear set to drive the ring gear and the vertical shaft connected to the gearbox.

13 Claims, 4 Drawing Sheets

(51) Int. Cl.

| | |
|---|---|
| ***B63H 21/30*** | (2006.01) |
| ***B63H 21/38*** | (2006.01) |
| ***B63H 23/02*** | (2006.01) |

(56) References Cited

U.S. PATENT DOCUMENTS

| | | | |
|---|---|---|---|
| 2008/0113840 | A1 | 5/2008 | Batistic |
| 2009/0253317 | A1 | 10/2009 | Wong et al. |
| 2010/0167604 | A1 | 7/2010 | Inaba |
| 2015/0232163 | A1 | 8/2015 | Hartmeyer et al. |
| 2016/0059949 | A1 | 3/2016 | Rebele et al. |
| 2019/0112019 | A1 | 4/2019 | Raimondi |
| 2019/0249590 | A1 | 8/2019 | Li et al. |

FOREIGN PATENT DOCUMENTS

| | | | |
|---|---|---|---|
| DE | 102005050021 | A1 | 4/2007 |
| EP | 3085615 | A1 | 10/2016 |
| JP | 2005153727 | A | 6/2005 |
| JP | 2005162055 | A | 6/2005 |
| WO | 2012035914 | A1 | 3/2012 |
| WO | 2015073084 | A1 | 5/2015 |

OTHER PUBLICATIONS

International Preliminary Report on Patentability in corresponding International Application No. PCT/EP2019/086665 mailed Nov. 23, 2021 (7 pages).

Chinese Office Action dated Mar. 19, 2025 in corresponding Chinese Patent Application No. 201980103034.4, 20 pages.

* cited by examiner

MARINE PROPULSION UNIT AND MARINE VESSEL

CROSS-REFERENCE TO RELATED APPLICATIONS

This application is a U.S. National Stage application of PCT/EP2019/086665, filed Dec. 20, 2019 and published on Jun. 24, 2021, as WO 2021/121623, all of which is hereby incorporated by reference in its entirety.

TECHNICAL FIELD

The present invention relates to a marine propulsion unit and a marine vessel with such a propulsion unit.

BACKGROUND

Known marine vessels comprising a propulsion unit in the form of a stern drive are usually provided with an internal combustion engine (ICE) arranged within the hull of the vessel. Torque is then transmitted from the ICE to the stern drive via a transmission comprising shafts and gearing in order to drive a set of propellers on the stern drive.

Mounting a drive unit, such as an ICE or an electric motor, and the transmission required for such a drive unit within the hull of the vessel can require a significant amount of space. In operation, heat from the drive unit must be removed using a cooling system which as a rule employs water drawn in from the ambient marine environment. This often involves drawing in saline water from the sea and pumping it through the coolant system, which can cause problems with corrosion. Further, a vibration generated by rotary components in the drive unit and the transmission requires vibration isolation and dampers to be installed to avoid undesirable vibrations from being transmitted to the hull or other parts of the vessel. Finally, the transmission must pass through the transom of the vessel to reach the stern drive and the propellers. This requires a suitable sealing arrangement between an opening in the transom and a rotary transmission shaft to prevent water from leaking through the hull.

A possible solution to the above problems can be to provide an azimuthing propulsion unit or pod extending downwards beneath the hull. An example of such an azimuthing pod is shown in U.S. Pat. No. 6,685,516. In this case the drive unit and its transmission can be mounted within a pod at one end of a leg extending downwards from the hull. However, this solution entails a significant draft and is mainly suited for larger vessels. In addition to the relatively large draft, it is not possible to tilt the propulsion unit out of the water when not in use. This will in turn increase the amount of marine growth on the submerged propulsion unit, which increases drag and reduces the efficiency of the propeller/-s.

The invention provides an improved marine propulsion unit aiming to solve the above-mentioned problems.

SUMMARY

An object of the invention is to provide a marine propulsion unit for a vessel, which propulsion unit solves the above-mentioned problems.

The object is achieved by a marine propulsion unit and a marine vessel comprising such a propulsion unit according to the appended claims.

In the subsequent text, the term "stern drive" is defined as an assembly comprising an outdrive having two sub-units.

An upper unit contains drive units and a transmission and is enclosed in a stern drive housing. A lower unit contains a vertical driveshaft receiving power from the transmission in the upper unit and a gearbox providing power to a propeller shaft for driving at least one propeller. The component parts of the lower unit are enclosed in a gearbox housing. The upper and lower units are separated by a cavitation plate. A stern drive according to the invention is mounted to the transom of a marine vessel, but differs from a conventional stern drive in that it does not comprise an inboard drive unit. The vessel is steered by pivoting the propulsion unit, or outdrive, relative to the transom. The propulsion unit can be pivoted up for trailer travel and between uses to avoid fouling.

According to a first aspect of the invention, the invention relates to a marine propulsion unit comprising a stern drive mounted to a transom of a marine vessel. The stern drive comprises an upper unit enclosed in a stern drive housing and a lower unit enclosed in a gearbox housing, wherein the gearbox housing contains a gearbox arranged to drive at least one propeller. The propulsion unit further comprises at least two electric motors arranged in the stern drive housing, which electric motors are mounted with vertical output shafts. A planetary gear set is arranged between the at least two electric motors in the stern drive housing and the gearbox in the gearbox housing. A vertical shaft in the gearbox housing is attached to a ring gear of the planetary gear set at its upper end and is connected to the gearbox at its lower end. The axis of the vertical shaft is arranged parallel to the output shafts of the electric motors and the rotatable shafts of the gears making up the planetary gear set. The output shaft of each electric motor is connected to a planetary gear arranged in the planetary gear set to drive the ring gear, which in turn drives the vertical shaft connected to the gearbox.

By mounting the electric motors with their rotary axes in a vertical direction and selecting motors having a suitable size, the motors can be fitted within a stern drive housing having the same or approximately the same shape and size as conventional stern drive housings. A further advantage is that the interface for mounting the stern drive to the transom and the connection to its steering gear can be maintained. The cut-out opening and sealing means for a drive shaft from an inboard drive unit can be eliminated.

According to one example, the planetary gear set is arranged in or adjacent a cavitation plate located between the stern drive housing and the gearbox housing. According to a preferred example, the ring gear is arranged in the cavitation plate. The at least two electric motors are mounted in equidistant, fixed positions around the circumference of a sun gear in the planetary gear set. In this way, two motors will be separated by 180°, three motors by 120°, four motors by 90°, and so on. The planetary gears are supported by the sun gear, which gear is rotatable and also ensures that the motors are rotated at the same speed.

According to a further example, the electric motors are mounted in direct contact with the housing of the planetary gear set. By mounting the housings of the electric motors directly onto the planetary gear set housing, the upper unit can be made compact and the output shafts of the motors can be kept short. In one example, each planetary gear can be mounted directly to the output shaft of its respective motor.

According to a further example, the planetary gear set has a gear ratio of at least 3:1 from the output shafts of the electric motors to the vertical shaft connected to the ring gear. In order to achieve a configuration that allows the stern drive housing to be kept with a size that is the same or marginally larger than a conventional stern drive housing, the size of the electric motors should be selected accordingly. One way of achieving this is to use high speed electric motors. In this context, a high speed electric motor is defined as a motor operable at speeds up to approximately 10.000 rpm or higher. A suitable maximum rotational speed of the vertical shaft driving the gearbox can be selected between 3.500-4.000 rpm, when it is desirable to use a conventional gearbox for a stern drive normally operated by an ICE. For electrical motors operable at speeds up to 10.000 rpm a suitable gear ratio for the planetary gear set would be 3:1, while a suitable gear ratio for electrical motors operable up to 25.000 rpm would be 6:1. As indicated above, the marine propulsion unit can be provided with a planetary gear set comprising at least two planetary gears. Alternative the planetary gear sets can have three or four planetary gears. The maximum number of planetary gears is limited by the space available for electric motors within the stern drive housing.

Under certain operating conditions the propulsion unit can be arranged to drive the at least one propeller with at least one electric motor. One such operating condition can be that the demanded or required power output from the propulsion unit can be achieved by operating fewer than the total number of available electric motors. The electric motors can drive the propellers together, independently or in variable combinations in response to different torque and power demands in order to improve the efficiency of the propulsion unit. The effect of the planetary gear set is to allow the use of high speed electric motors with a corresponding reduced output torque. In this way the cost of the propulsion unit is lowered, while the electric motors can be operated in a high-efficiency area.

A further operating condition can be a so called limp-home mode the propulsion unit is arranged to drive the at least one propeller when at least one or only one electric motor is operable. This arrangement provides a redundancy for the propulsion unit and ensures that the vessel can be operated even if one or more electric motors are inoperable.

According to a further example, the propulsion unit comprises a closed coolant and lubrication circuit for the gearbox, the planetary gear set and each electric motor. The gearbox housing can comprise a reservoir for a liquid lubricant and coolant. The closed coolant and lubrication circuit comprises a pump, a supply conduit connected to conduits for the electric motors and the planetary gear set, and a return conduit connected to the reservoir. The pump is preferably, but not necessarily, located in the reservoir. The provision of a closed coolant and lubrication circuit allows the propulsion unit to be cooled without the use of water from the surrounding body of water. This is a particular advantage if the vessel is operated in saline or polluted waters. A further advantage is that the same system can be used for lubrication, wherein separate pumps and circuits for lubrication can be dispensed with, which provides a reduction of both cost and space requirement.

According to a second aspect of the invention, the invention relates to a marine vessel provided with a marine propulsion unit as described in the above examples.

The propulsion unit according to the invention solves the problem of providing a stern drive with electric propulsion without requiring significant modifications of existing units. In most cases the outdrive can be advantageously provided with a stern drive housing having the same or approximately the same shape and size as conventional stern drive housings. Further, the interface for mounting a stern drive and its steering gear connections can be maintained. As the inboard drive unit can be eliminated there is no need for an opening through the transom or for an associated sealing means for a drive shaft. A further advantage of the invention is that the provision of a planetary gear set allows relatively small, high speed electric motors to be used while maintaining a sufficient level of torque to the gearbox and propeller/-s. As the planetary gear set can be accommodated within the cavitation plate, the stern drive can be kept relatively compact. The electric motors can drive the propellers together, independently or in variable combinations in response to different torque and power demands whereby the efficiency of the propulsion unit is improved. By allowing independent operation of at least a single motor the arrangement provides a redundancy for the propulsion unit and ensures that the vessel can be operated even if one or more electric motors are inoperable.

Further advantages and advantageous features of the invention are disclosed in the following description and in the dependent claims.

BRIEF DESCRIPTION OF THE DRAWINGS

With reference to the appended drawings, below follows a more detailed description of embodiments of the invention cited as examples. In the drawings.

DETAILED DESCRIPTION OF EXAMPLE EMBODIMENTS OF THE INVENTION

Figure 1:
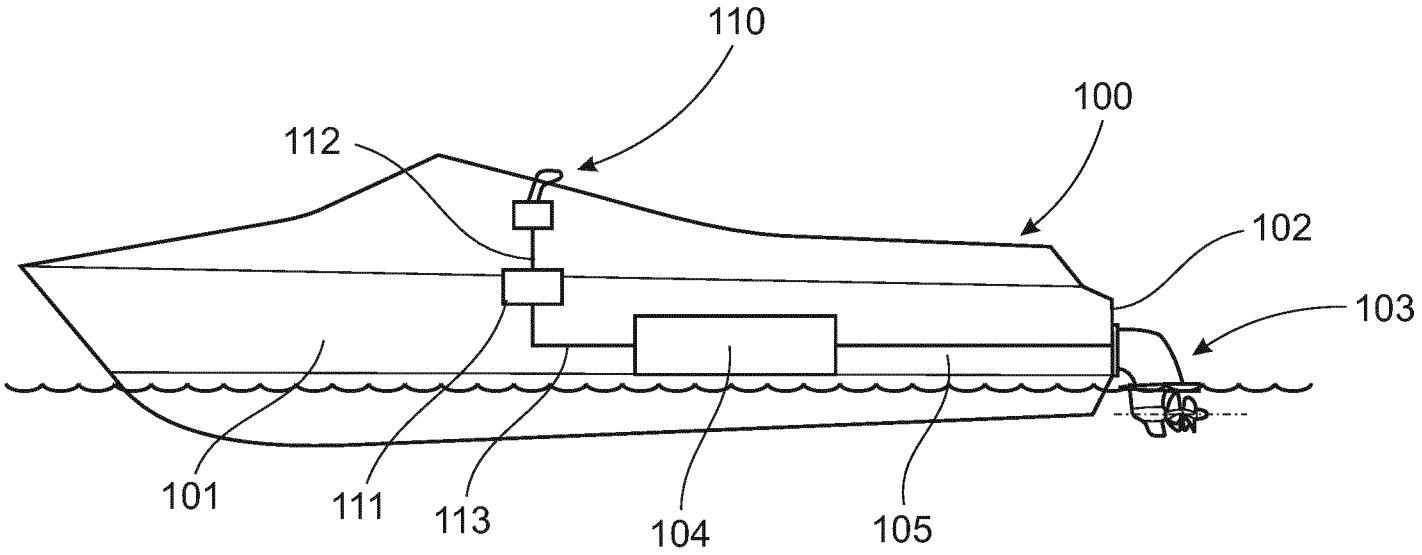
FIG. 1 shows a side view of a schematically illustrated vessel comprising a marine propulsion unit according to the invention.

FIG. 1 shows a side view of a schematically illustrated marine vessel 100 comprising a marine propulsion unit 103 according to the invention. The marine propulsion unit 103 is mounted to a transom 102 on the vessel 100. Electric motors (see FIG. 2) in the marine propulsion unit 103 are connected to an inboard battery pack 104 via suitable wiring 105. The battery pack 104 is indicated schematically in FIG. 1 and is preferably located below the waterline of the vessel hull 101 where it can act as ballast and contribute to the stability of the vessel 100.

The marine propulsion unit 103 is controllable by a control means such as a throttle lever 110 located at an operating position. The throttle lever 110 is connected to an electronic control unit (ECU) 111 via suitable wiring 112, which ECU 111 is connected to the battery pack 104 via additional wiring 113. The battery pack also comprises a power electronic controller (PEC) and an electronic controller for calibrating and charging the battery pack. Electronic controllers of this type are known in the art and will not be described in further detail here.

Figure 2:
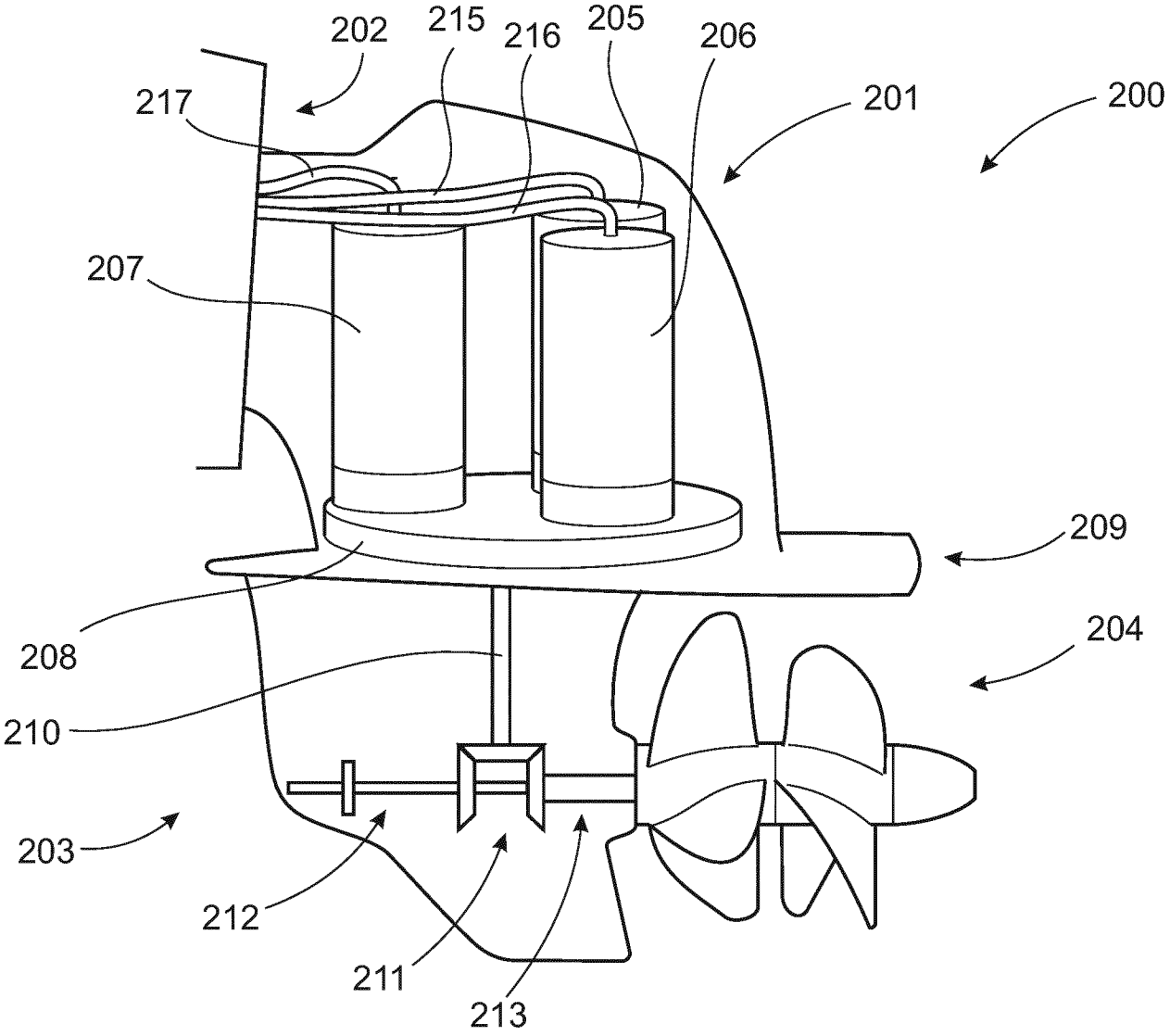
FIG. 2 shows a schematic perspective view of a propulsion unit according to the invention.

FIG. 2 shows a schematic perspective view of a propulsion unit according to the invention. FIG. 2 shows a stern drive 200 mounted to a transom 202 of a marine vessel (see FIG. 1). The stern drive 200 comprises an upper unit enclosed in a stern drive housing 201 and a lower unit enclosed in a gearbox housing 203. The gearbox housing 203 contains a gearbox 211 arranged to drive a pair of counter rotating propellers 204. The propulsion unit in this example comprises three electric motors 205, 206, 207 arranged in the stern drive housing 201, which electric motors 205, 206, 207 are mounted vertically with their output shafts extending downwards in a vertical direction. A planetary gear set 208 is arranged between the three electric motors 205, 206, 207 located within the stern drive housing 201 and the gearbox 211 located within in the gearbox housing 203. A vertical shaft 210 in the gearbox housing 203 is attached to a ring gear (see FIGS. 3A-3C) of the planetary gear set 208 at its upper end and is connected to the gearbox 211 at its lower end. The axis of the vertical shaft 210 is arranged parallel to the output shafts of the electric motors 205, 206, 207 and the rotatable shafts of the gears making up the planetary gear set 208. The output shaft of each electric motor 205, 206, 207 is connected to a planetary gear (see FIGS. 3A-3C) arranged in the planetary gear set 208 to drive the ring gear, which in turn drives the vertical shaft 210 connected to the gearbox 211. The gearbox 211 comprises bevel gears arranged to drive a first and a second drive shaft 212 and 213, respectively, to drive the pair of counter rotating propellers 204. By mounting the electric motors 205, 206, 207 with their rotary axes in a vertical direction and selecting motors having a suitable size, the motors can be fitted within a stern drive housing 201. The interface for mounting the stern drive 200 to the transom 202 and the connection to its steering gear (not shown) can be the same as the outdrive for a conventional stern drive.

A planetary gear set according to the invention can be arranged in or adjacent a cavitation plate located between the stern drive housing and the gearbox housing. According to the example in FIG. 2, the ring gear of the planetary gear set 208 is arranged in such a cavitation plate 209, as the cavitation plate itself or the area adjacent the cavitation plate generally has a larger extension in the horizontal plane than the stern drive housing 201 or the gearbox housing 203. The three electric motors 205, 206, 207 are mounted in equidistant, fixed positions around the circumference of a sun gear in the planetary gear set (see FIGS. 3A-3C). In this way, the three motors 205, 206, 207 are separated by 120° around the sun gear. The planetary gears are supported by the sun gear, which gear is rotatable and also ensures that the motors 205, 206, 207 are rotated at the same speed.

In the example shown in FIG. 2, the housings of the electric motors 205, 206, 207 are mounted in direct contact with the housing of the planetary gear set 208. In this way, the upper unit of the stern drive and the stern drive housing 201 can be made compact and the output shafts of the motors can be kept short. According to one example, each planetary gear can be mounted directly to the output shaft of its respective motor.

Figure 3A:
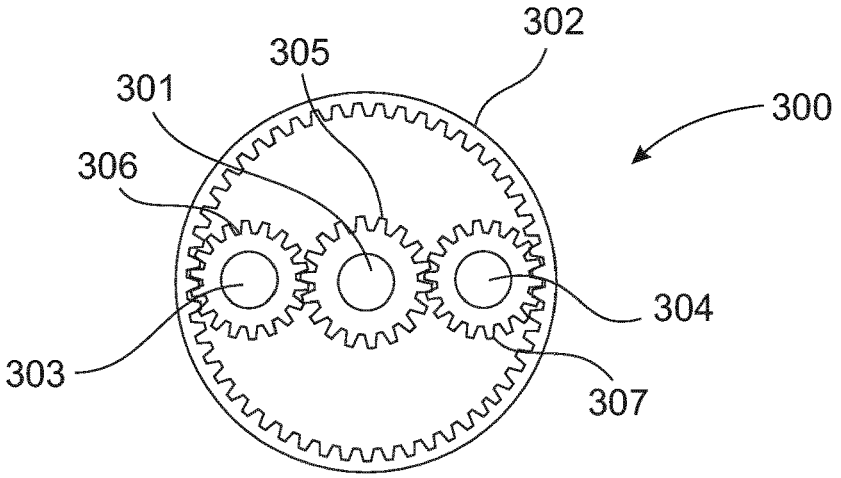
FIG. 3A-C show schematic plan views of cross-sections through embodiments of a planetary gear sets for a propulsion unit according to the invention.
Figure 3B:
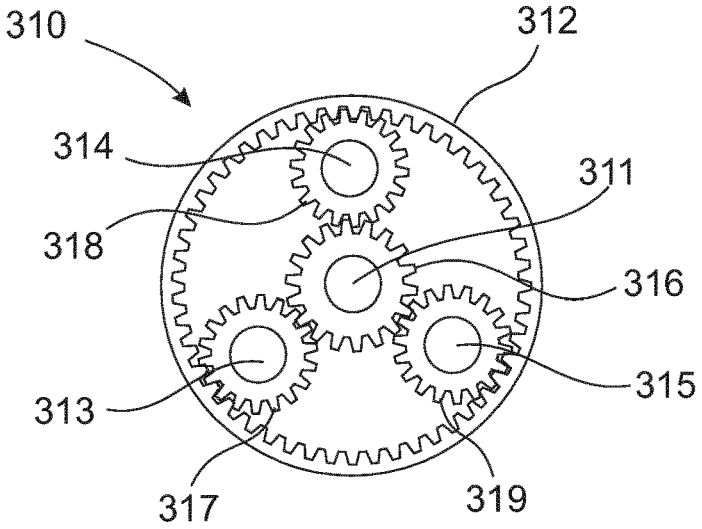
Figure 3C:
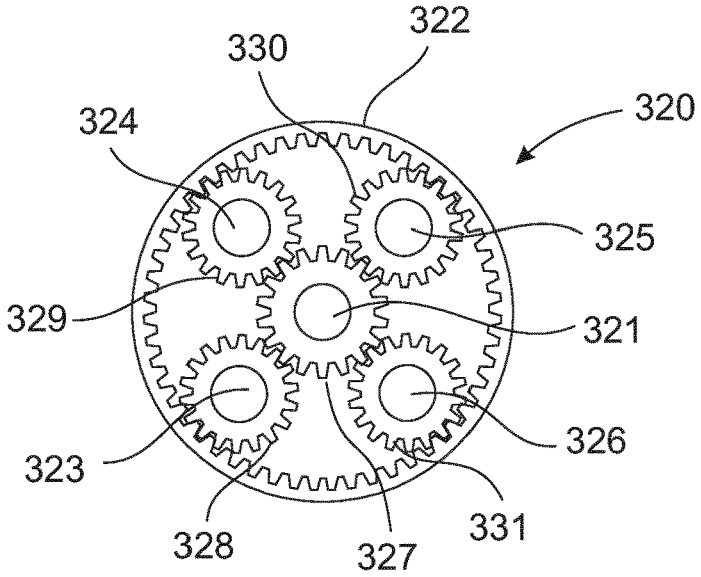

FIG. 3A-C show schematic plan views of cross-sections through different embodiments of a planetary gear sets for a propulsion unit according to the invention. FIG. 3A shows a first planetary gear set 300 arranged in or adjacent a cavitation plate located between a stern drive housing and a gearbox housing (see FIG. 2). FIG. 3A shows a first planetary gear set 300 where the output shafts 303, 304 of two electric motors (not shown) are fixed to a first and a second planetary gear 306 and 307, respectively. The first and second planetary gears 306, 307 are mounted in equidistant, fixed positions separated by 180° around the circumference of a sun gear 305 in the planetary gear set 300. The planetary gears 306, 307 are arranged to drive a ring gear 302, which in turn drives a vertical shaft connected to the gearbox below the planetary gear set (see FIG. 2). Operation of the electric motors causes a rotation of the first and second planetary gears 306, 307, which in turn drives the ring gear 302. The sun gear 305 mounted on a separate shaft 301 and is freely rotatable about its axis. The sun gear 305 provides support for the first and second planetary gears 306, 307 and assists in synchronizing the speed of the electric motors.

FIG. 3B shows a second planetary gear set 310 arranged in or adjacent a cavitation plate located between a stern drive housing and a gearbox housing (see FIG. 2). FIG. 3B shows a second planetary gear set 310 where the output shafts 313, 314, 315 of three electric motors (see FIG. 2) are fixed to a first, a second and a third planetary gear 317, 318 and 319, respectively. The first, second and third planetary gears 317, 318, 319 are mounted in equidistant, fixed positions separated by 120° around the circumference of a sun gear 316 in the planetary gear set 310. The planetary gears 317, 318, 319 are arranged to drive a ring gear 312, which in turn drives a vertical shaft connected to the gearbox below the planetary gear set (see FIG. 2). Operation of the electric motors causes a rotation of the first, second and third planetary gears 317, 318, 319, which in turn drives the ring gear 312. The sun gear 316 mounted on a separate shaft 311 and is freely rotatable about its axis, as described in the above example.

FIG. 3C shows a third planetary gear set 320 arranged in or adjacent a cavitation plate located between a stern drive housing and a gearbox housing (see FIG. 2). FIG. 3C shows a third planetary gear set 320 where the output shafts 323, 324, 325, 326 of four electric motors (not shown) are fixed to a first, a second, a third and a fourth planetary gear 328, 329, 330 and 331, respectively. The first, second, third and fourth planetary gears 328, 329, 330, 331 are mounted in equidistant, fixed positions separated by 90° around the circumference of a sun gear 327 in the planetary gear set 320. The planetary gears 328, 329, 330, 331 are arranged to drive a ring gear 322, which in turn drives a vertical shaft connected to the gearbox below the planetary gear set (see FIG. 2). Operation of the electric motors causes a rotation of the first, second and third planetary gears 328, 329, 330, 331, which in turn drives the ring gear 322. The sun gear 327 mounted on a separate shaft 321 and is freely rotatable about its axis, as described in the above example.

The planetary gear sets in the examples described above have a gear ratio of at least 3:1 from the output shafts of the electric motors to the vertical shaft connected to the ring gear. According to the invention it is preferable to use high speed electric motors for the propulsion unit. In this context, a high speed electric motor is defined as a motor operable at speeds up to about 10.000 rpm or higher. A desirable maximum rotational speed of the vertical shaft driving the gearbox can be selected between 3.500-4.000 rpm. Such an arrangement allows the stern drive from a conventional ICE driven unit to be used, without having to modify the gearbox or gearbox housing. For electrical motors operable at speeds up to 10.000 rpm a suitable gear ratio for the planetary gear set would be 3:1, while a suitable gear ratio for electrical motors operable at speeds up to 25.000 rpm would be 6:1. As indicated above, the marine propulsion unit can be provided with a planetary gear set comprising at least two planetary gears, or alternatively three or four planetary gears. The maximum number of planetary gears is limited by the space available for electric motors within the stern drive housing.

Figure 4:
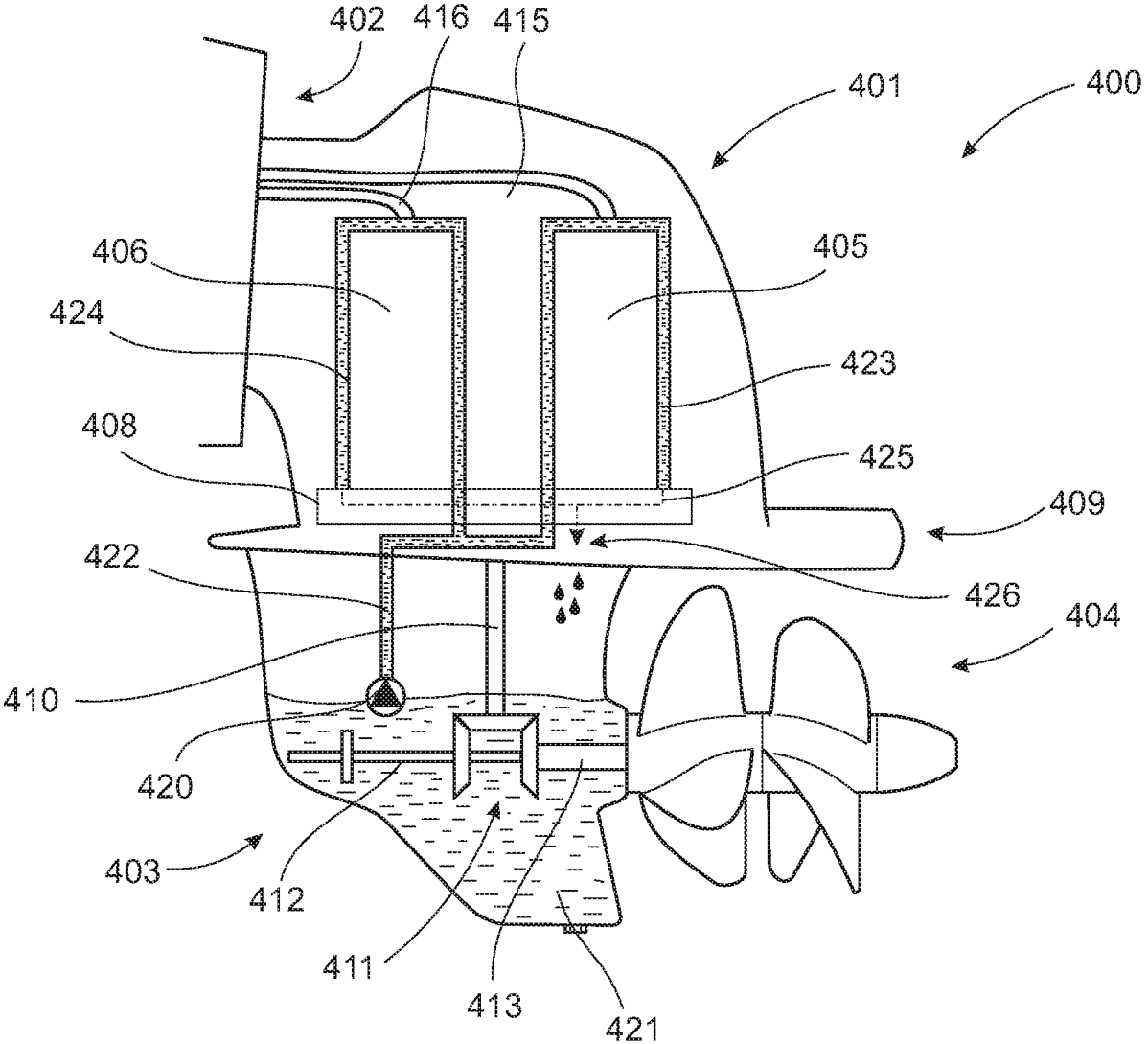
FIG. 4 shows a schematic side view of a coolant and lubricant circuit in a propulsion unit according to the invention.

FIG. 4 shows a schematic side view of a coolant and lubricant circuit in a propulsion unit according to the invention. FIG. 4 shows a propulsion unit 400 comprising a closed coolant and lubrication circuit for a gearbox 411, 421, 413, a planetary gear set 408 and a pair of electric motors 405, 406. The gearbox 411, 421, 413 are enclosed by a gearbox housing 403 which comprises a reservoir 421 for a liquid lubricant and coolant. The closed coolant and lubrication circuit comprises a pump 420, a supply conduit 422 connected to conduits 423, 424 for cooling the electric motors 405, 406 and a conduit 425 supplying the coolant/lubricant to the planetary gear set 408. A return conduit 426 is connected to the reservoir 421 to return the coolant/lubricant from the planetary gear set 408. In the example shown in FIG. 4 the pump 420 is located in the reservoir 421. The provision of a closed coolant and lubrication circuit allows the propulsion unit to be cooled without using water from the surrounding body of water. The arrangement also allows the same system to be used for both cooling and lubrication.

It is to be understood that the present invention is not limited to the embodiments described above and illustrated in the drawings; rather, the skilled person will recognize that many changes and modifications may be made within the scope of the appended claims.

The invention claimed is:

1. Marine propulsion unit comprising a stern drive mounted to a transom, which stern drive comprises an upper unit enclosed in a stern drive housing and a lower unit enclosed in a gearbox housing; wherein the gearbox housing contains a gearbox arranged to drive at least one propeller, wherein the propulsion unit further comprises:

at least two electric motors arranged in the stern drive housing, which electric motors are mounted with vertical output shafts;

a planetary gear set arranged between the at least two electric motors and the gearbox, and a vertical shaft that is attached to a ring gear of the planetary gear set at its upper end and is connected to the gearbox at its lower end;

wherein the output shaft of each electric motor is connected to a planetary gear arranged in the planetary gear set to drive the ring gear and the vertical shaft connected to the gearbox.

2. Marine propulsion unit according to claim 1, wherein the planetary gear set is arranged in or adjacent a cavitation plate between the stern drive housing and the gearbox housing.

3. Marine propulsion unit according to claim 2, wherein the ring gear is arranged in the cavitation plate.

4. Marine propulsion unit according to claim 1, wherein the electric motors are mounted in equidistant, fixed positions around the circumference of a rotatable sun gear.

5. Marine propulsion unit according to claim 4, wherein the planetary gears are supported by a rotatable sun gear.

6. Marine propulsion unit according to claim 1, wherein the electric motors are mounted in direct contact with a housing for the planetary gear set.

7. Marine propulsion unit according to claim 1, wherein the planetary gear set has a gear ratio of at least 3:1.

8. Marine propulsion unit according to claim 1, wherein the planetary gear set comprises three planetary gears.

9. Marine propulsion unit according to claim 1, wherein the planetary gear set comprises four planetary gears.

10. Marine propulsion unit according to claim 1, wherein the propulsion unit is arranged to drive the at least one propeller with at least one electric motor.

11. Marine propulsion unit according to claim 1, wherein the propulsion unit comprises a closed coolant and lubrication circuit for the gearbox, the planetary gear set and each electric motor.

12. Marine propulsion unit according to claim 11, wherein the gearbox housing comprises a reservoir for a liquid lubricant and coolant.

13. Marine propulsion unit according to claim 12, wherein the closed coolant and lubrication circuit comprises a pump, a supply conduit connected to the electric motors and the planetary gear set, and a return conduit connected to the reservoir.

* * * * *